US008302551B2

(12) United States Patent
Julnes

(10) Patent No.: US 8,302,551 B2
(45) Date of Patent: Nov. 6, 2012

(54) FOLDABLE CONE

(75) Inventor: Jon Julnes, Snohomish, WA (US)

(73) Assignee: Vanguard ADA Systems of America, Inc., Snohomish, WA (US)

( * ) Notice: Subject to any disclaimer, the term of this patent is extended or adjusted under 35 U.S.C. 154(b) by 129 days.

(21) Appl. No.: 12/871,596

(22) Filed: Aug. 30, 2010

(65) Prior Publication Data

US 2010/0319607 A1 Dec. 23, 2010

Related U.S. Application Data

(63) Continuation-in-part of application No. 12/253,680, filed on Oct. 17, 2008, now Pat. No. 7,823,526.

(60) Provisional application No. 61/070,696, filed on Mar. 24, 2008.

(51) Int. Cl.
*E01F 9/012* (2006.01)

(52) U.S. Cl. ..... 116/63 C; 116/63 P

(58) Field of Classification Search ..... 116/63 R, 116/63 P, 63 C, 63 T; 40/124.07, 124.09, 40/124.14, 124.15, 124.16, 602, 606.12, 40/610, 612; D10/109.1, 113.4; 404/6
See application file for complete search history.

(56) References Cited

U.S. PATENT DOCUMENTS

| | | | | |
|---|---|---|---|---|
| 735,486 | A * | 8/1903 | Fels | 40/610 |
| 2,282,280 | A | 5/1942 | Yogg | |
| 2,449,911 | A * | 9/1948 | Roth | 40/539 |
| 2,869,504 | A | 1/1959 | Andrews | |
| 2,881,662 | A | 4/1959 | Harris | |
| 2,935,238 | A | 5/1960 | Koehler | |
| 2,975,905 | A | 3/1961 | Foland | |
| 2,991,699 | A | 7/1961 | Murray, Sr. | |
| 3,195,255 | A | 7/1965 | Toulmin, Jr. | |
| 3,322,093 | A | 5/1967 | Goland | |
| 4,253,777 | A | 3/1981 | Pillifant, Jr. | |
| 4,383,782 | A * | 5/1983 | Pillifant, Jr. | 404/6 |
| 4,928,415 | A * | 5/1990 | Walters | 40/610 |
| 5,090,349 | A | 2/1992 | Wilson | |
| 5,621,992 | A | 4/1997 | Mandell | |
| 5,915,852 | A | 6/1999 | Rogers | |
| 6,199,504 | B1 | 3/2001 | Freeman | |

(Continued)

FOREIGN PATENT DOCUMENTS

CN 1142558 A 2/1997

(Continued)

OTHER PUBLICATIONS

Depiction of a warning cone available for sale as early as Mar. 23, 2007, 1 page.

(Continued)

*Primary Examiner* — R. A. Smith
(74) *Attorney, Agent, or Firm* — Christensen O'Connor Johnson Kindness PLLC

(57) ABSTRACT

The foldable cone includes first and second side panels that are tapered in the upward direction, each side panel having an outer surface and an inner surface, a lower edge, an upper edge, and opposing side edges. The cone further includes base panel having a folding seam extending along the central portion thereof in a direction generally parallel to the lower edges of the side panels, wherein the base panel folds along the folding seam. The first and second side panels are secured together at a predetermined location to define concave first and second side panels when the base panel is unfolded.

18 Claims, 16 Drawing Sheets

U.S. PATENT DOCUMENTS

| | | | | |
|---|---|---|---|---|
| 6,338,213 | B1 * | 1/2002 | Young et al. | 40/610 |
| 6,651,367 | B1 | 11/2003 | Barragan | |
| 6,776,117 | B2 | 8/2004 | D'Onofrio | |
| 7,057,530 | B2 * | 6/2006 | Young | 340/908 |
| 7,325,345 | B2 | 2/2008 | Hailo | |
| D598,798 | S | 8/2009 | Tsui | |
| 2009/0235860 | A1 | 9/2009 | Julnes | |

FOREIGN PATENT DOCUMENTS

| | | | |
|---|---|---|---|
| CN | 201420244 | Y | 3/2010 |
| GB | 2 148 360 | A | 5/1985 |
| GB | 2 274 478 | A | 7/1994 |
| GB | 2 346 403 | A | 8/2000 |
| JP | 7-229114 | A | 8/1995 |
| JP | 10-1918 | A | 1/1998 |
| JP | 10-131135 | A | 5/1998 |
| JP | 2008250271 | A * | 10/2008 |
| JP | 2011248007 | A * | 12/2011 |
| KR | 20-0262245 | Y1 | 3/2002 |
| KR | 10-0657460 | B1 | 12/2006 |
| KR | 10-2009-0067826 | A | 6/2009 |
| WO | 2009/007695 | A1 | 1/2009 |

OTHER PUBLICATIONS

International Search Report and Written Opinion mailed May 25, 2009, issued in corresponding International Application No. PCT/US2008/084977, filed Nov. 26, 2008, 5 pages.

Office Action mailed Apr. 2, 2010, in U.S. Appl. No. 12/253,680, filed Oct. 17, 2008, now U.S. Patent No. 7,823,526, which is the parent of the present application, 17 pages.

Examination Report dated Oct. 7, 2011, issued in corresponding New Zealand National Phase Application No. 588657, filed Nov. 26, 2008. 3 pages.

First Office Action, mailed Mar. 23, 2012, in corresponding Chinese Application No. 200880129497.X, filed Nov. 26, 2008, 20 pages.

International Search Report and Written Opinion mailed Mar. 15, 2012, issued in corresponding Application No. PCT/US2011/048655, filed Aug. 22, 2011, 8 pages.

* cited by examiner

S2
S3
S4
S5
S6
S7
S8
S9
S10
S11
S12
S13
S14
S15
S16
S17
S18
S19
S20
S21
S22
S23
S24
S25
S26
S27
S28
S29
S30
S31
S32
S33
S34
S35
S36
S37
S38
S39
S40
S41
S42

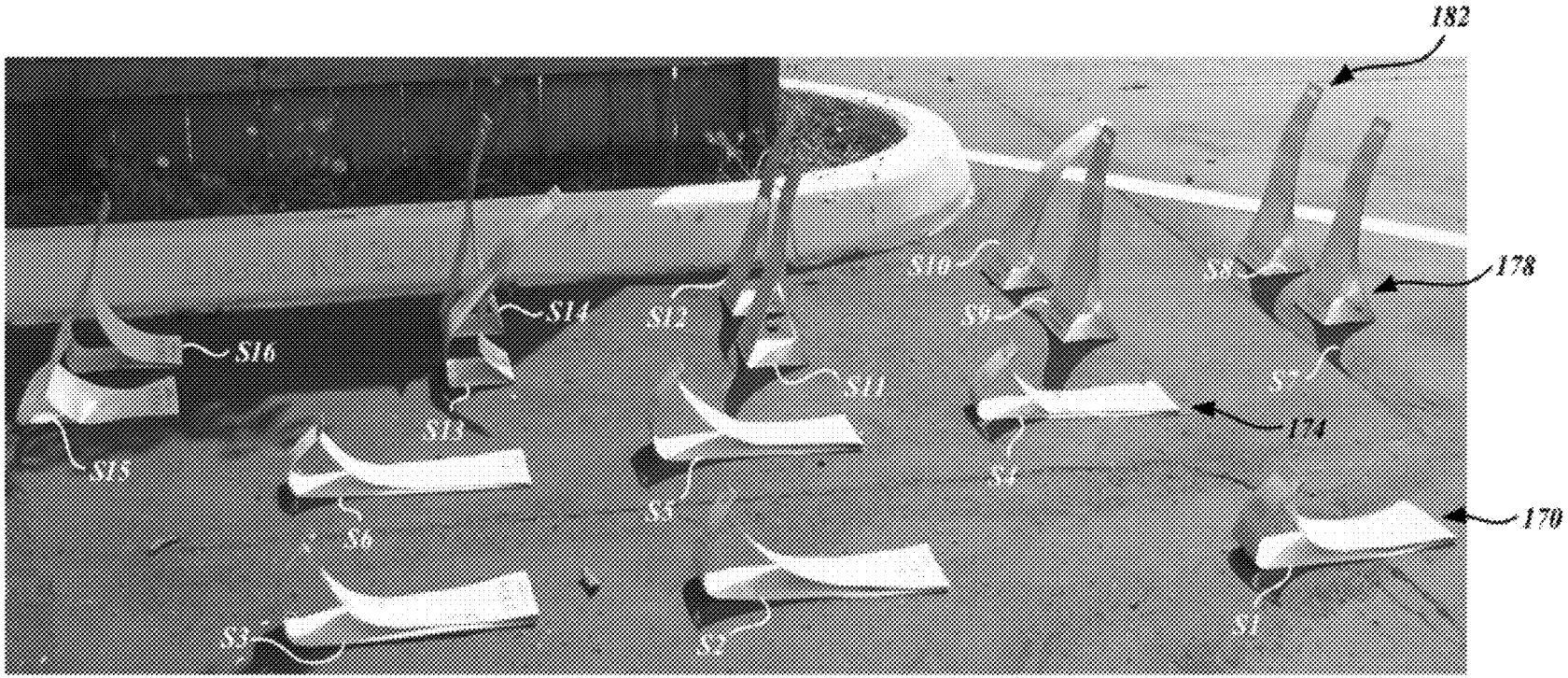
182
178
170
174
176
176
176

FOLDABLE CONE

The present application is a continuation-in-part of U.S. application Ser. No. 12/253,680, filed Oct. 17, 2008 and claims the benefit of U.S. Provisional Application No. 61/070,696, filed Mar. 24, 2008, the disclosures of which are hereby expressly incorporated herein.

BACKGROUND

The present invention pertains to a foldable warning cone that is usable at any number of locations as a visible alert to passers-by. Frequently, warning cones are placed on roads to mark a change in traffic flow, such as the merging of lanes or the temporary closure of a lane, or to indicate construction in a lane or along side of a road. Warning cones are also used to indicate a closed or inaccessible section of a sidewalk or other walkway or to warn to pedestrians of a hazardous condition. Additionally, warning cones are also commonly used indoors, for example, to denote a closed area such as a restroom or to indicate a dangerous condition such as a slippery floor. Also, the warning cones can be used to cordon off a suspected or actual crime scene or a location where a fire or accident has occurred. It is advantageous for warning cones to be easily seen and readily moveable. Traditional warning cones are constructed out of plastic or rubber.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present disclosure relates to a foldable cone that includes first and second side panels that are tapered in the upward direction, each side panel having an outer surface and an inner surface, a lower edge, an upper edge, and opposing side edges. A first lateral crimp line may be formed near a first edge of the first and second side panels and a second lateral crimp line may be formed near a second edge of the first and second side panels. The cone further includes base panel having a folding seam extending along the central portion thereof in a direction generally parallel to the lower edges of the side panels, wherein the base panel folds along the folding seam. The first and second side panels are secured together at a predetermined location to define concave first and second side panels when the base panel is unfolded. The first and second side panels may be secured together at a distance that is in between 50-70% of the height of the side panel.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

FIG. 16 is a photograph of the foldable cone samples of FIG. 10 taken after a sixth predetermined amount of time.

DETAILED DESCRIPTION

The present invention pertains to a foldable warning cone 10 that is usable at any number of indoor and outdoor locations to provide a visible warning to passers-by. Such usage can occur at a construction, repair or maintenance site, for a road, building, sidewalk, parking lot, etc. Other locations may include a crime scene, site of an accident, or a fire site. The foldable warning cone 10 may also be used indoors to indicate a dangerous condition such as a slippery floor or as an indicator of a closed or off-limits area such as a restroom, walkway, escalator, or section of a hall, stadium or the like. The present invention may also be used by motorists that must stop their vehicles along a road, highway or street due to, for example, mechanical problems or running out of gasoline. In short, the present invention may be utilized anywhere that warning cones, flares, or similar warning devices are employed. The present invention has the advantage over standard rigid cones in that the present invention is foldable so as to occupy very little volume for convenient shipment or storage, is easily "erected" for use, and after use may be refolded for subsequent use or disposed of. Also, the present invention does not present a fire danger in the manner of roadside flares.

Figure 1:
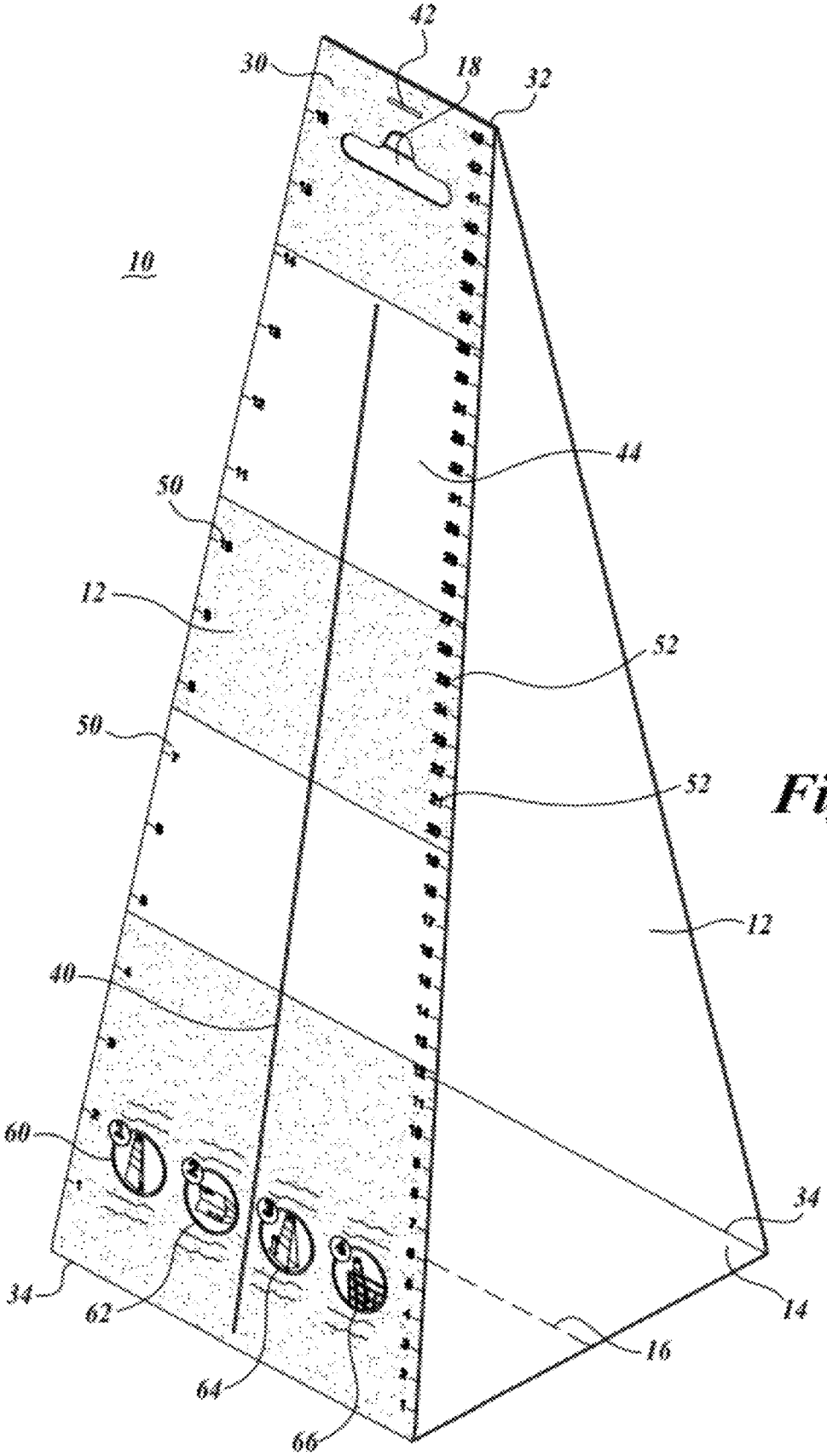
FIG. 1 is a perspective view of one embodiment of the foldable cone, shown fully deployed, with flat base surface.
Figure 2:
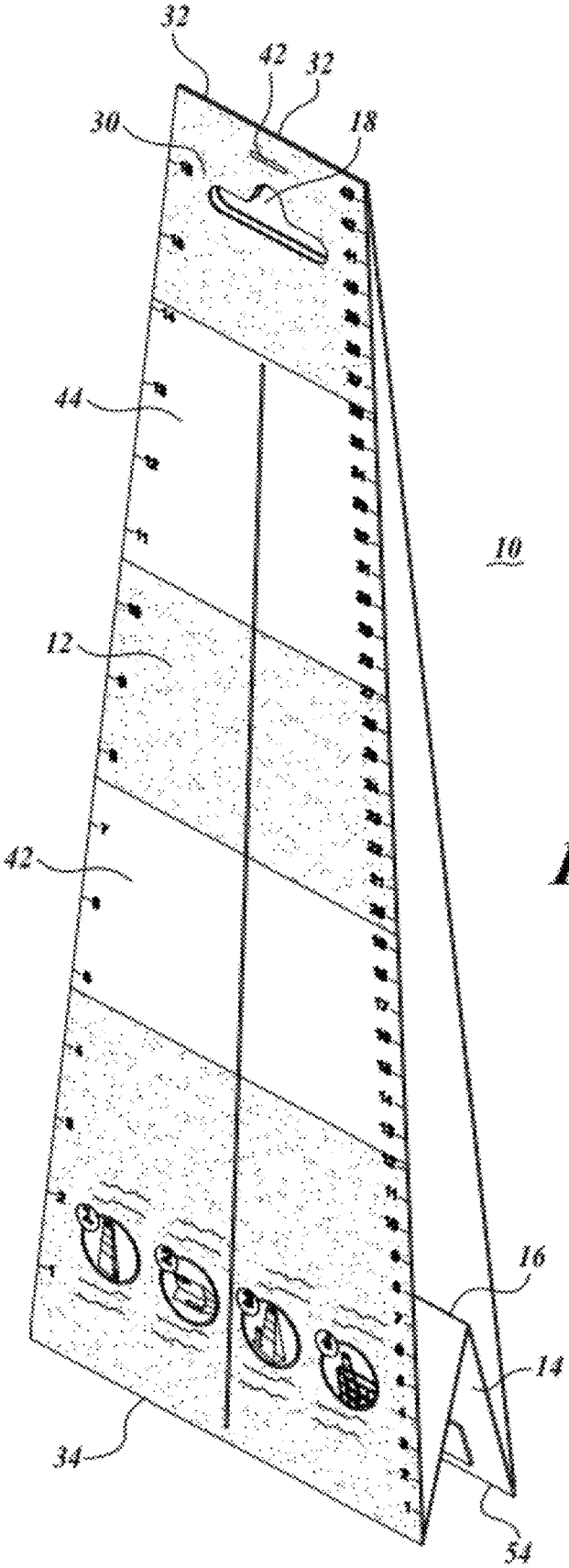
FIG. 2 is a perspective view of one embodiment of the foldable cone, illustrating the cone in folded configuration.

FIG. 1 is a perspective view of one embodiment of the foldable cone 10 showing the cone fully deployed, in its upright, or standing, position. In construction, the foldable cone 10 of the present invention includes two tapered side panels 12 and a base panel 14. The tapered side panels have upper end portions 30, upper edges 32, and lower edges 34. The base panel 14 extends between the lower edges 34 of the two side panels 12 and includes a folding seam 16 extending along the central portion of the base panel in the direction generally parallel to the lower edges 34 of the side panels. As shown in FIG. 2, the folding seam 16 allows the base panel 14 to fold upwardly to enable the cone to collapse into a very thin configuration.

Figure 5:
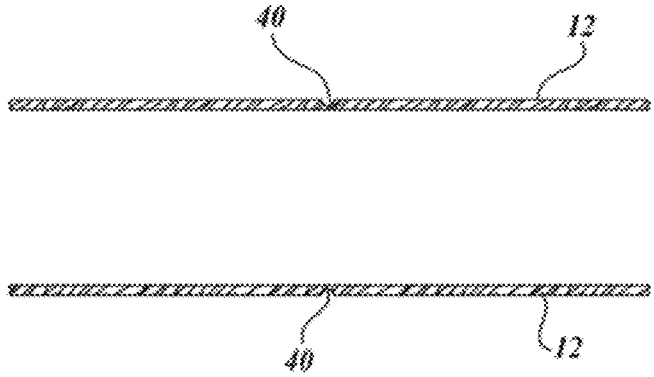
FIG. 5 is a cross-sectional view of FIG. 4, taken along lines 5-5 thereof.

As shown in FIGS. 1 and 5, a crimp or indentation 40 along a longitudinal central line can be formed in the side panels 12 by pressing against the panel. This crimp or indentation imparts increased stiffness and structural rigidity to the side panels. Although one crimp/indentation line 40 is shown, more than one line can be utilized. The inventor has found that the crimp/indentation can significantly increase the useable life of the cone, especially in rain or other wet weather, wherein the side panels if made of paper remain rigid for a significantly longer period of time than if not "treated" with the crimp/indentation.

Figure 4:
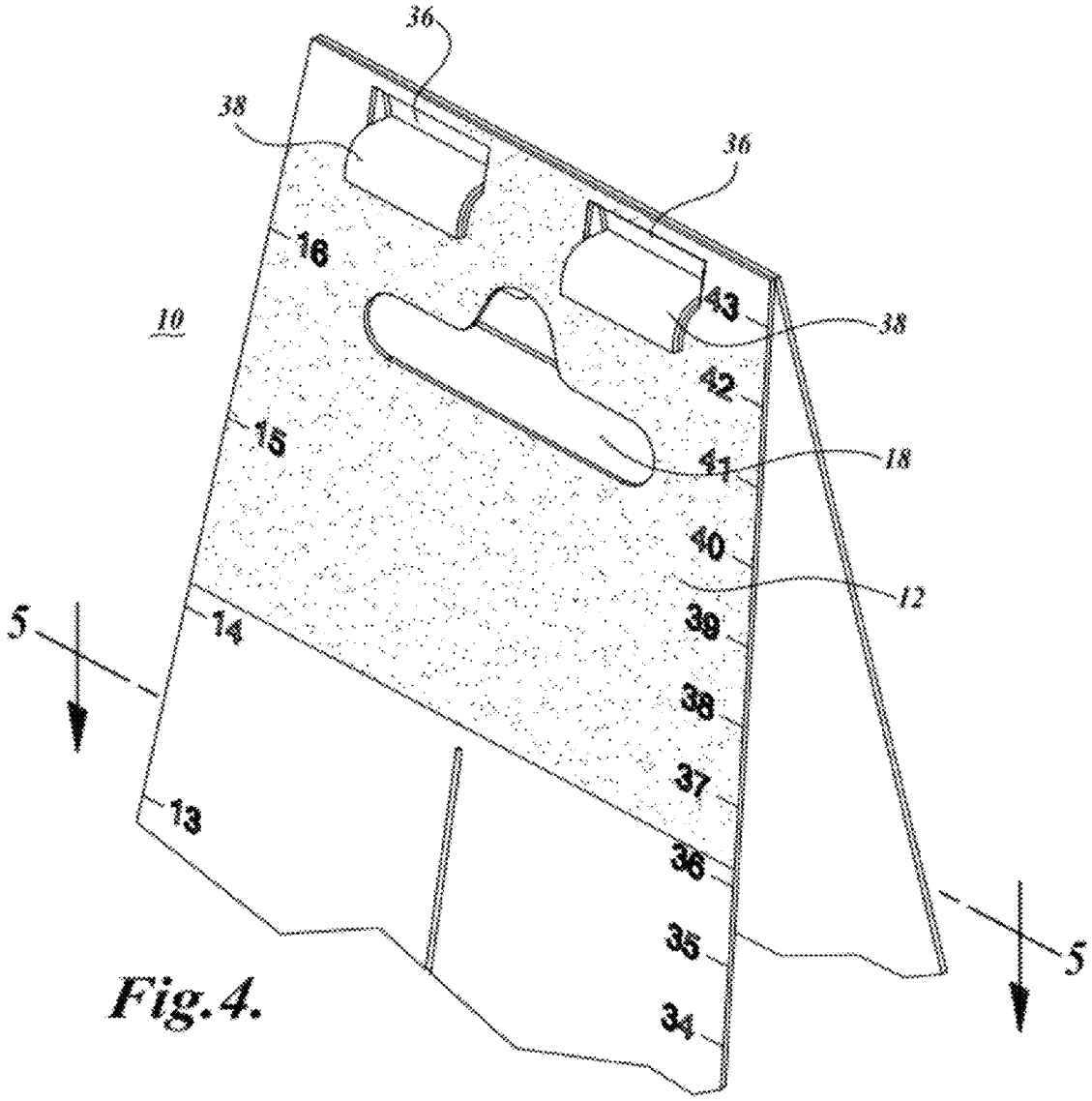
FIG. 4 is a cut away view of one embodiment of the foldable cone, showing attachment of the side panels by insertion of tabs into corresponding slots.

The upper end portions 30 of the side panels 12 are attached together by stapling, gluing, or any other means including other adhesion means. FIG. 1 illustrates the side panels attached by stapling 42. Alternately, as shown in FIG. 4, one side panel is formed with one or two tabs 38 that engage into a corresponding slot or slots 36 formed in the second side panel, thereby securing the side panels 12 together.

A central slot 18 is formed in the upper portion 30 of the side panels to serve various functions. For example, the slot can be used to engage over a rod or arm in a store display or rack. The slot can also be used to receive banner tape that can be strung between cones to, for example, "rope off" an area.

As shown in the drawings, the base panel 14 may be substantially squared in shape when in an extended position, see FIG. 1. However, the base may also take other shapes as its width and length are altered. That is, the width of the base, the dimension spanning between the lower edges 34 of the side panels 12, may be shorter or longer than the length of the base, the dimension extending along the lower edges 34 of each of the two side panels 12.

Figure 3A:
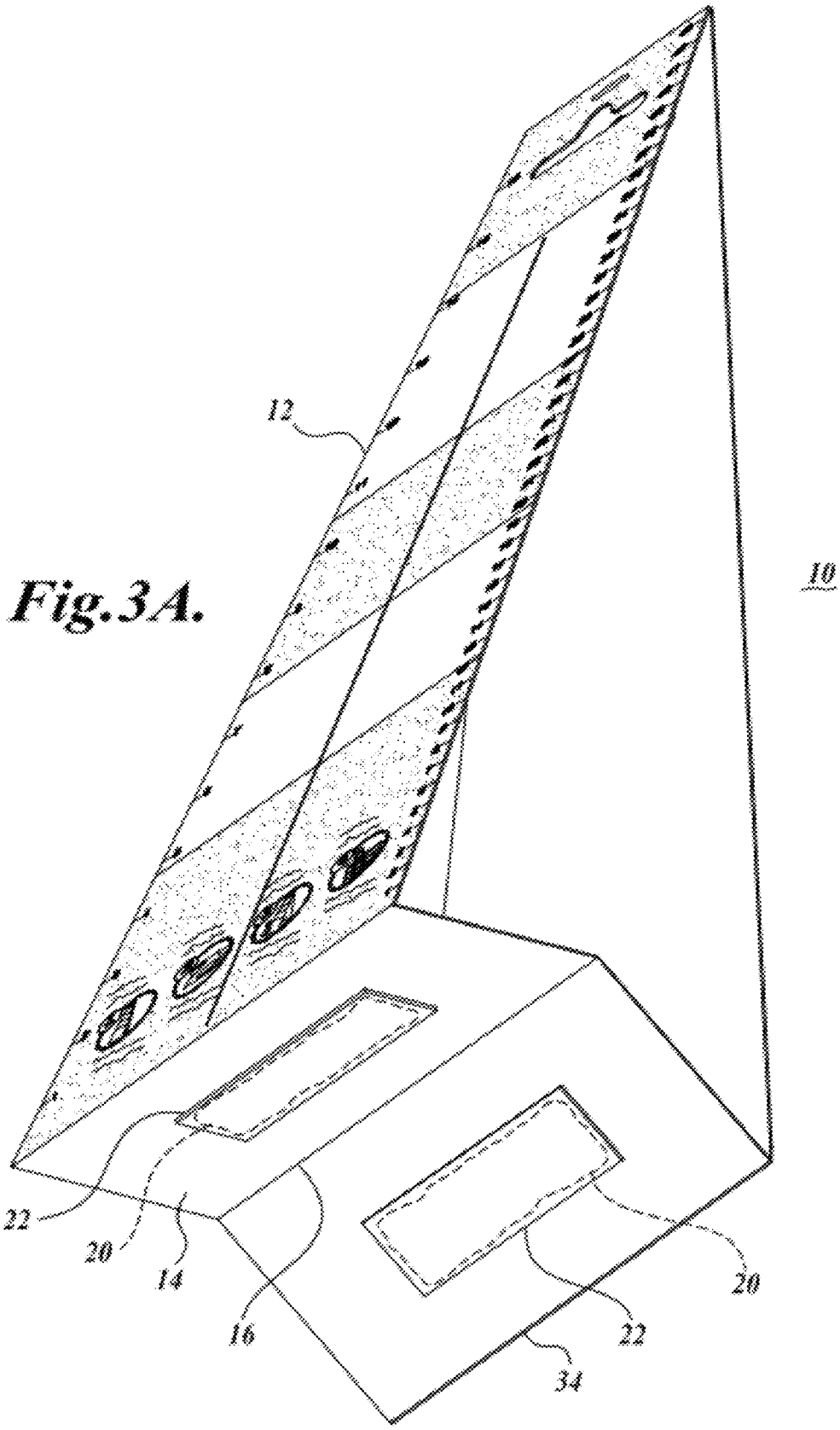
FIG. 3A is a perspective view of one embodiment of the foldable cone, showing the bottom or base.
Figure 3B:
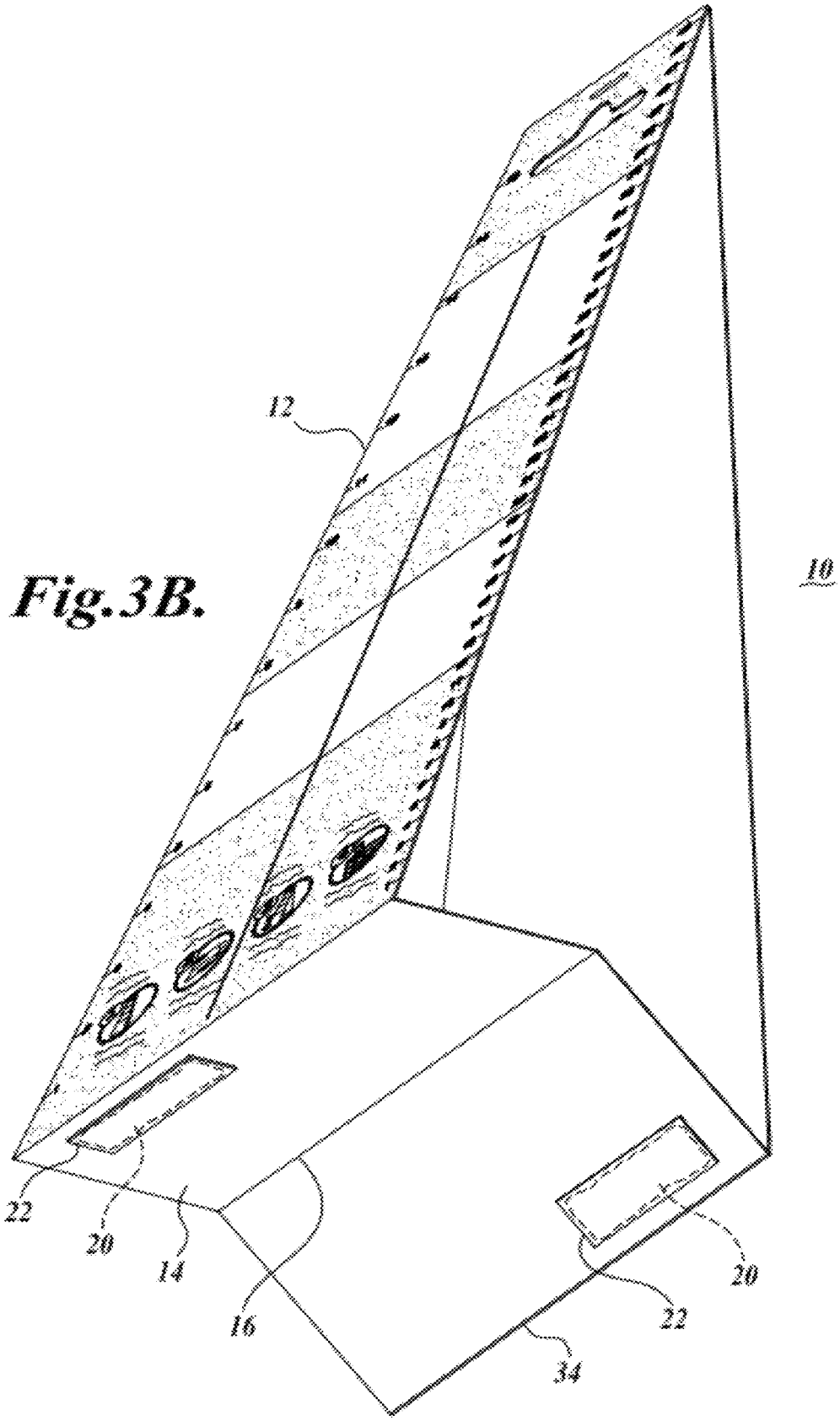
FIG. 3B is a perspective view of one embodiment of the foldable cone showing the bottom or base.

Referring to FIG. 3, an adhesive material 20 may be placed on the underside of the base panel 14 to restrain the cone from moving once placed in a desired location. The adhesive 20 is shown as applied in two strips, one on each of the two sub-panels of the base. The adhesive may be of any appropriate composition, such as of an asphalt, tar, or butyl material composition, of a tacky polymeric composition, etc. A removable peel strip 22 may be placed over the adhesive strips 20 for convenient removal when the cone 10 is positioned in a desired location. The peel strip 22 prevents the two adhesive strips from sticking together when the base panel 14 is in folded position. Of course, the adhesive can be positioned at other locations under the base panel; for example, along the perimeter or in the center of the base underside, or on the entirety of the base panel underside. If placed along the perimeter adjacent the lower edges 34 of the side panels, the strips 20 can be positioned at opposite ends of the base, as shown in FIG. 3B, so that the strips do not overlap each other when the base panel 14 is folded. In this manner, the folded warning cone is thinner than if the strips overlap each other. This allows more cones to be shipped or stored per given volume. In addition to or as an alternative to the adhesive 20, a weight may be placed on the base panel to help prevent movement of the cone 10. Such weight can be any item that is handy, such as a rock or piece of wood. Also, it will be appreciated that use of adhesive 20 enables the cone 10 to be mounted on sloped surfaces or even vertical or near vertical surfaces.

The foldable cone may be composed of various materials. One preferable material is paper. For durability, the paper can have a "slick" exterior finish so as to be water-repellant. This finish may be of a plastic, wax or other water-resistant composition. A range of different weights of paper can be used, from industrial, high-weight paperboard to lighter weight paper which is still rigid enough to stand upright. By constructing the side panels from paper, the side panels are able to flex somewhat if subjected to wind, thereby being less likely to topple over than if constructed from substantially rigid material. Also, when erected, the folding cone 10 is substantially hollow so that side winds will simply flow through the hollow interior of the cone. The cone 10 can be constructed from other materials, such as a plastic or relatively rigid fabric. These materials may be water repellant and/or water resistant.

Rather than being constructed from a single sheet of paper material, the foldable cone can be composed of multi-layered paper. Moreover, the foldable cone can be composed of a sandwich construction wherein an interior layer might be composed of thin fabric, plastic, or even of metallic or foil material, thereby to significantly increase the structural integrity of the foldable cone.

It will also be appreciated that the side panels 12 of the cone 10 taper in the upward direction. The width of the upper edges 32 of the side panels 12 is preferably from one-quarter to one-half the width of the lower edges 34 of the side panels 12. This adds to the stability of the structure, especially in the wind, since there is less area for the wind to impact against at the upper portion of the cone, thus reducing the force that could cause the cone to tip over.

The exterior of the foldable cone can be of various colors. Typically the color would be that of a traditional cone. Such color might be yellow, orange, red, or green, for example. Also, the color might be fluorescent in order to be more visible in low light or at night. Alternatively or in addition, the material comprising the cone may be reflective, such as reflective paper or plastic, or have reflective sections, for example, portions of the cone may be painted with reflective paint or may bear reflective stickers or decals.

Further, the exterior surfaces of the side panels 12 may be printed with a warning indicia. Such indicia might include the words "Warning," "Crime Scene," "Danger," "Wet Surface," or "Wet Paint," for example. Alternatively or in addition, strips of a contrasting color may be printed, placed, or painted on the cone side panels 12 to improve the visibility of the cone. For example, the cone may be red or orange, or other color, with white stripes that are positioned vertically, horizontally, or diagonally.

In FIG. 1 the stripes are shown as horizontal. Also, sections 44 of the exterior of the cone, or the entire exterior of the cone, may be white in color or of a light enough color shade so that crime scene numbers or other information might be written on the cone with an appropriate pen or other type of writing instrument, such as a pen sold under the trademark Sharpie®.

As most clearly shown in FIG. 1, indicia 50 may be applied along the side edges of the side panel 12 to indicate the height of the side panel. Such indicia might be along one or both sides of the side panel. Moreover, the indicia 50 might be in inches along one side and different indicia 52 in metric measurements along the other side of the side panel. Such indicia would be helpful when photographs are taken at the location of the foldable cone, for instance, at a crime scene, accident scene, fire scene, etc. Such indicia provides a reference with respect to size measurements in such photographs. This eliminates the need for investigators to utilize an ad hoc size reference in the photographs, for example, a pen or pencil.

Also as most clearly shown in FIG. 1, visual instructions can be provided with respect to the proper use of the foldable cone. As shown in FIG. 1, four illustrations 60, 62, 64 and 66 are provided in this regard. Illustration 60 shows how the foldable cone is to be opened. Illustration 62 indicates that the peel strips 22 are to be removed. Illustration 64 indicates that pressure is to be applied to the base of the cone so as to cause the adhesive 20 to secure the base to the surface. Illustration 66 indicates that the cone is to be properly disposed of after usage has been completed. In addition to the visual illustrations, instructions in writing can be provided adjacent each illustration. The instructions can be in multiple languages, such as English, Spanish, French, etc. Such instructions can be in one language above the illustration and a further language below the illustration. Moreover, illustrations 60-66 might be used on both of the side panels 12, in which case the illustrations on one side panel can be in a different language than the illustrations on the other side panel. In this manner, the foldable cone can be truly used universally.

The cone 10 may be of various sizes depending on usage. The height of the cone—distance from the folding seam 16 of the base panel 14 to the upper edges 32 of the side panels—may be as short as perhaps 12 to 15 inches, or as tall as perhaps two to three feet. The width of the lower edges 34 of the cone side panels 12 may be from about one-third to one-half the height of the cone to provide sufficient stability for the cone, especially when used in exterior or outdoor applications. As mentioned previously, the width of the upper edges 32 of the side panels may be from one-quarter to one-half of the width of the lower edges 34 of the side panels.

In storage and shipment, the cone 10 may be in folded position as shown in FIG. 2, thereby occupying very little volume. In use, the base panel 14 is simply flattened into a planar configuration as shown in FIG. 1. The adhesive 20 may be set relative to the floor, road surface, or other surface on which the cone is placed by simply using one's foot to press down on the upper surface of the base, which is easily accomplished since the cone is hollow. After usage has been completed, the cone may be simply lifted off its surface and the base 14 folded upwardly for storage or disposal of the cone.

It will be appreciated that foldable cone 10 provides many advantages over cones of fixed, rigid shape. For example, cones 10 are relatively inexpensive to manufacture. The cones also are relatively light in weight, decreasing the cost of shipment. Also, when not in use, the cones can be folded to very small volume, significantly reducing shipment costs and providing efficient storage. Also, the property owner or property manager at the site on which the disposable cones are used can remove the cones after use has been completed rather than requiring the law enforcement, fire department personnel, construction contractor, or other person or entity to return to the site to retrieve the cones. This can significantly reduce costs and expenses.

Referring to FIGS. 6-9, another embodiment of a foldable cone 100 formed in accordance with the present disclosure is depicted. The foldable cone 100 is substantially similar to the foldable cone 10 described above except for the differences hereinafter provided. In that regard, like numerals in the one hundred series have been used in FIGS. 6-9 to refer to like elements. Similar to the foldable cone 10, the foldable cone 100 includes two tapered side panels 112 and a base panel 114. The tapered side panels 112 have upper end portions 130, upper edges 132, and lower edges 134. The tapered side panels 112 further include side edges 135 that extend between the upper edges 132 and the lower edges 134. A rounded or contoured corner 137 may be defined between the side edges 135 and the upper edges 132 to help prevent the upper corners 137 of the foldable cone 100 from becoming caught on loose objects, damaging a surface, causing harm to an individual, etc.

The base panel 114 extends between the lower edges 134 of the two side panels 112 and includes a folding seam 116 extending along the central portion of the base panel 114 in the direction generally parallel to the lower edges 134 of the side panels 112. The folding seam 116 allows the base panel 114 to fold upwardly to enable the foldable cone 100 to collapse into a very thin configuration (similar to that shown with respect to the foldable cone 10 in FIG. 2).

As described above with respect to the foldable cone 10, the foldable cone 100 may be composed of any substantially rigid yet flexible, water resistant or repellant material or combination of various materials, such as paper coated in plastic, wax or other water-resistant composition. Other materials, such as plastic or rigid fabric, may also be used. Moreover, the foldable cone 100 may also be composed of multiple layers of material, such as a sandwich construction wherein an interior layer might be composed of thin fabric, plastic, or even of metallic or foil material, thereby to significantly increase the structural integrity of the foldable cone 100.

It can be appreciated that the portions of the foldable cone 100 may be cut out of a pre-assembled or manufactured piece of material. For instance, the side panels 112 and base 114 may be cut out of a piece of material as a single piece and thereafter bent at the edges 134 and secured along the top portion 130 to define the foldable cone 100. In the alternative, the foldable cone 100 may instead be formed from multiple pieces that are secured together.

Figure 6:
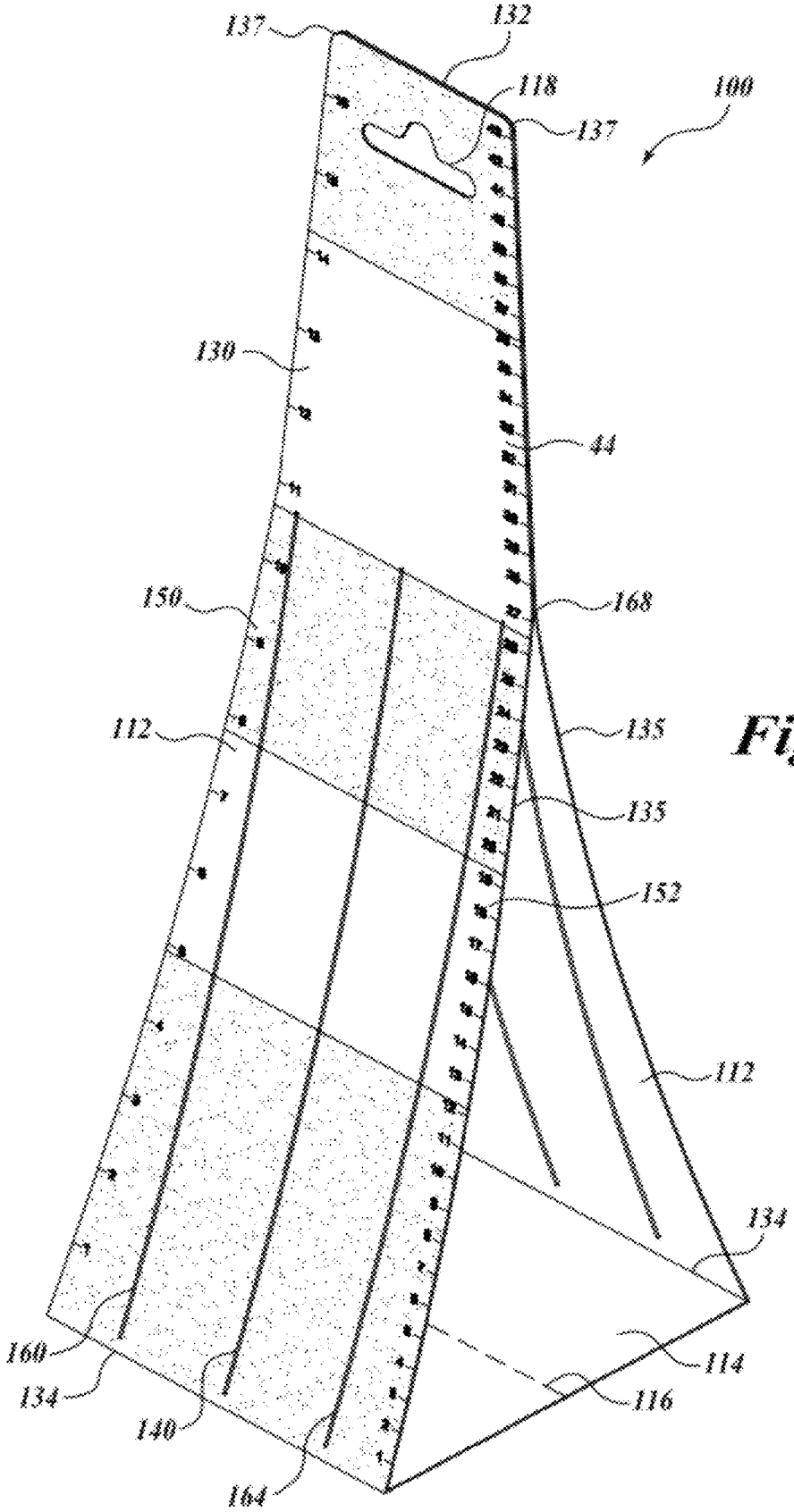
FIG. 6 is a perspective view of another embodiment of a foldable cone, shown fully deployed.
Figure 9:
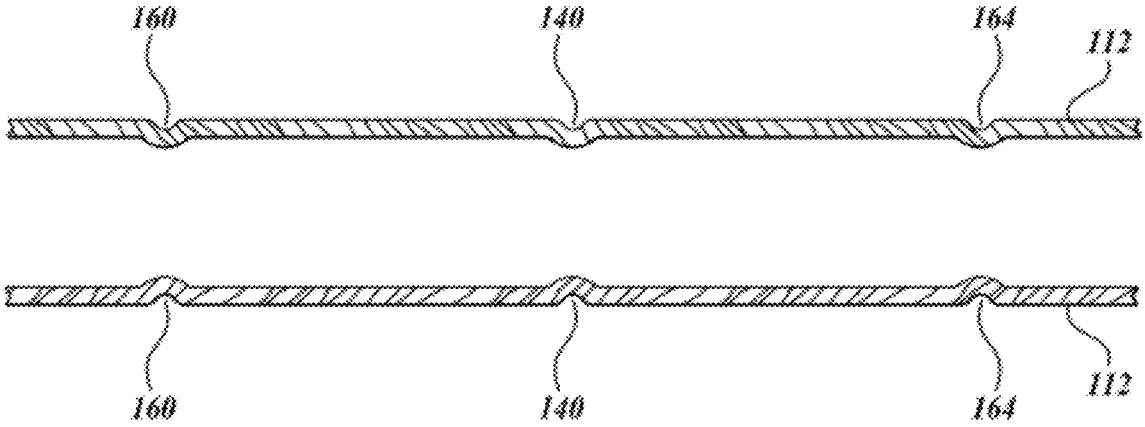
FIG. 9 is a cross-sectional view of FIG. 8, taken along lines 9-9 thereof.

As shown in FIGS. 6 and 9, a first central crimp or indentation 140 is formed longitudinally along a substantially central line in the side panels 112 to help increase the stiffness and structural rigidity of the side panels 112. The first central crimp/indentation 140 may be formed within the side panels 112 by any suitable means, such as by pressing against the panel 112, forming an impression in the panel 112, etc. To further increase the structural integrity and rigidity of the side panels 112, each panel 112 may be folded slightly along the first central crimp/indentation 140 when assembling the foldable cone 100.

The foldable cone 100 further includes second and third lateral crimps or indentations 160 and 164 formed longitudinally along the side panels 112 on each side of the first crimp or indentation 140. The first, second, and third crimps/indentations 140, 160 and 164 extend from the bottom edge 134 or just above the bottom edge 134 of the side panels 112 toward the upper end portion 130 of the side panels 112. The inventor has found that the first, second, and third crimps/indentations 140, 160 and 164 can significantly increase the useable life of the cone 100, especially in rain or other wet weather, wherein the side panels 112 if made of paper remain rigid for a significantly longer period of time than if not "treated" with the first, second, and third crimps/indentations 140, 160 and 164.

Moreover, the inventor has found that the second and third lateral crimps/indentations 160 and 164 help prevent the ingress of water if the cone 100 becomes wet. As noted above, the foldable cone 100 may be cut out of a pre-assembled or manufactured piece of material. In this regard, if the foldable cone 100 is made from a material having a water resistant or repellant coating, such as plastic or wax, it can be appreciated that the exposed side panel edges 135 would not have that coating. Accordingly, in wet or damp conditions, moisture can enter through the exposed side panel edges 135 and decrease the structural integrity of the foldable cone 100.

In one embodiment of the foldable cone 100, the exposed side panel edges 135 could be coated with a water resistant or water repellant material, such as wax, tape, etc., to help prevent the ingress of water. However, by coating the edges 135 with a water resistant or water repellant material, the cost of material and manufacturing time is increased.

In the depicted embodiment, the second and third lateral crimps/indentations 160 and 164 help prevent the ingress of water into the side panels 112 in wet or damp conditions to help increase the useable life of the cone 100. Specifically, when exposed to moisture, the water enters into the exposed side edges 135 and travels inwardly toward the center of the side panel 112. If the water were to saturate an entire horizontal section of a side panel 112 (i.e., saturation extending between the opposing side edges 135), it can be appreciated that the saturated horizontal section would be susceptible to bending, folding, etc., thereby decreasing the structural integrity of the foldable cone.

The second and third lateral crimps/indentations 160 and 164 alter the path of water traveling within the body of the side panel 112 to help prevent the water from creating a path of horizontal saturation across the body of the side panel 112. With the second and third lateral crimps/indentations 160 and 164 extending from the bottom edge 134 of the side panels 112 toward the upper end portion 130 of the side panels 112, the water entering the exposed side edges 135 is guided down toward the bottom edge 134 (through gravitational effects) by the lateral crimps/indentations 160 and 164. The water must travel down around the lower end of the lateral crimps/indentations 160 and 164 to move horizontally toward the center of the side panel 112. Accordingly, a majority of the moisture is retained on the lateral edges of the side panels 112 between the second and third lateral crimps/indentations 160 and 164 and the side panel edges 135 to help increase the structural stability of the side panel body 112.

Figure 7:
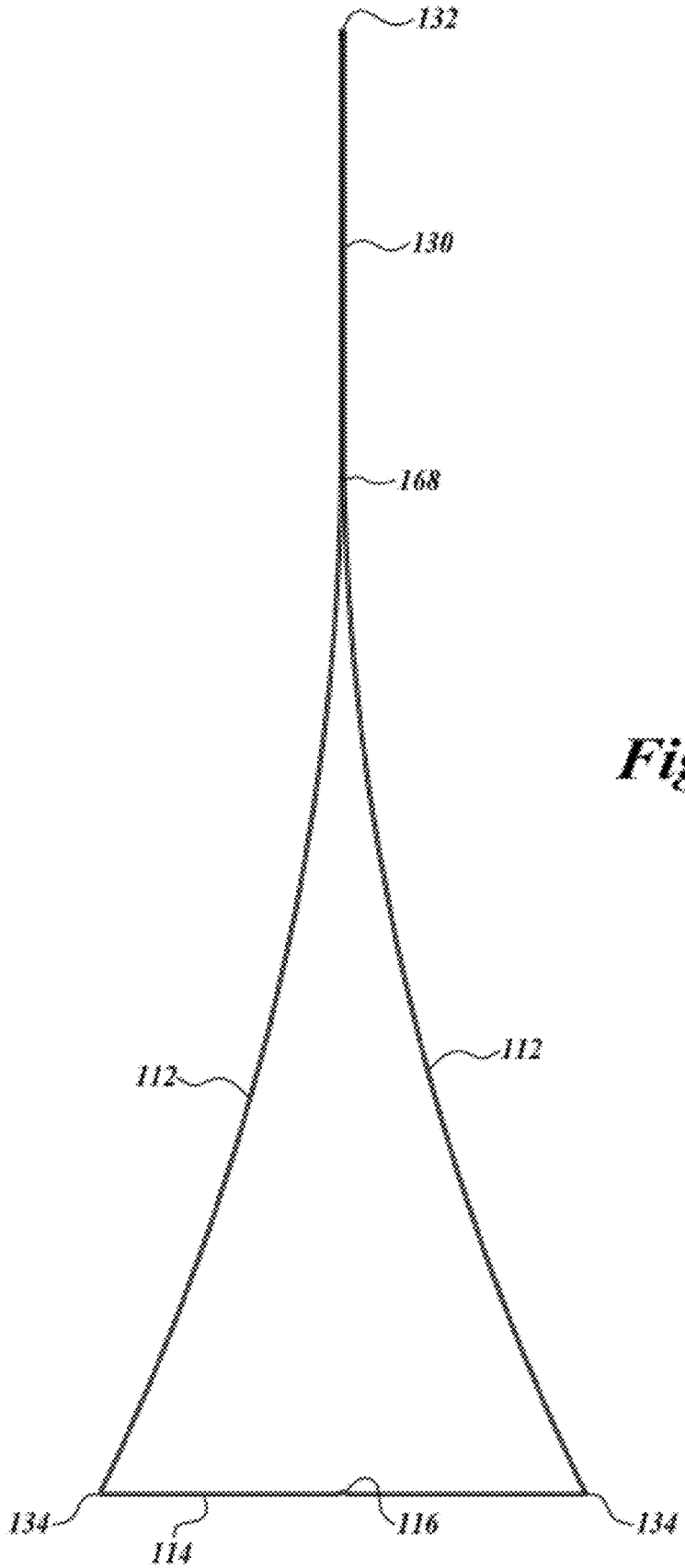
FIG. 7 is a side view of the foldable cone of FIG. 6.

Referring to FIGS. 6 and 7, the side panels 112 of the foldable cone 100 are secured together at their upper ends at a predetermined location to further help increase the structural integrity of the cone 100 when assembled and when in use. As described above with reference to the foldable cone 10, the side panels 112 are constructed from a somewhat flexible material, such as paper, so that the side panels may flex somewhat if subjected to wind, thereby being less likely to topple over than if constructed from substantially rigid material. However, as will be described in further detail below, it has been found by the inventor that the use of flexible material can also cause side panels 112 to bow or bend outwardly after a predetermined amount of time. When a side panel 112 bows outwardly, the foldable cone 100 falls toward the bowed-out side panel 112 until the bowed-out side panel 112 ultimately reaches the ground or other surface to which the base panel 114 is attached.

As such, the inventor has determined, through experimentation that securing the upper ends of the side panels 112 together at a predetermined height of the side panels 112, or at a predetermined distance from the bottom edges of the side panels, will help prevent the side panels 112 from bowing out. In the embodiment depicted in FIGS. 6 and 7, the interior surfaces of the side panels 112 are secured together by adhesive, glue, tape, etc., at a distance from the bottom edges of about 50-70% of the height of the side panels 112. The location at which the side panels 112 are secured together is designated by the reference numeral 168. It can be seen by referring to FIG. 7 that by securing the upper ends of the side panels 112 together at location 168, the side panels 112 are predisposed into a slightly concave configuration when the foldable cone 100 is assembled.

Figure 8:
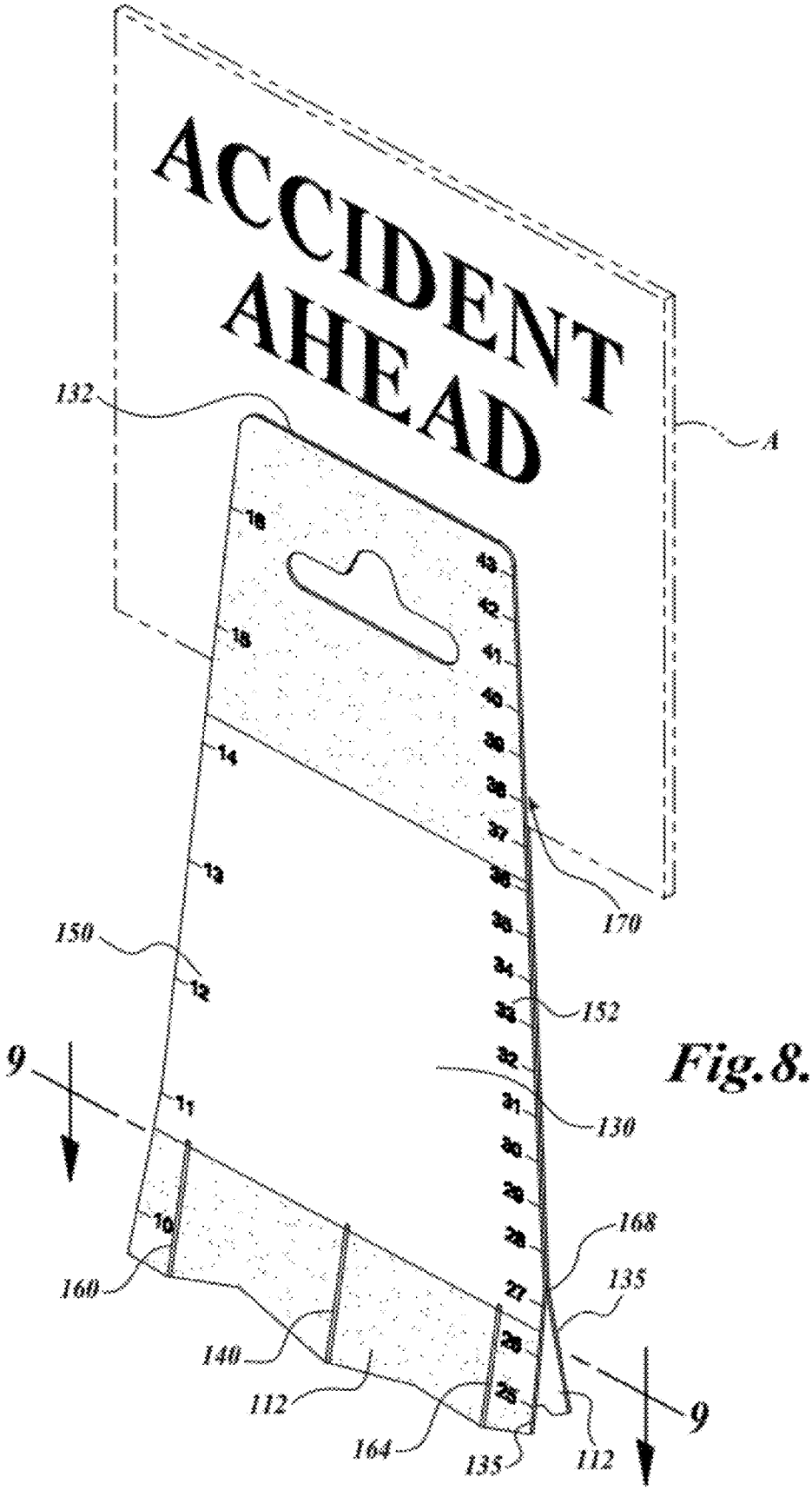
FIG. 8 is a partial perspective view of the foldable cone of FIG. 6, wherein the foldable cone is shown in use with a secondary sign.

The portion of the side panels 112 extending between location 168 and the upper edges 132 defines the upper end portion 130 of the side panels 112. It should be appreciated that the side panels 112 may be secured together along the entire length of the upper end portion 130 (i.e., from location 168 to the upper edge 132 of the side panels 112). In the alternative, the side panels 112 may be secured together along only a portion of the length of the upper end portion 130, or from location 168 to an area between location 168 and the upper edge 132 of the side panels 112. For instance, as shown in FIG. 8, the side panels 112 may be separated from one another near the top edge 132 to define a slot 170 between the upper ends of the side panels 112 for temporarily securing a secondary sign A therebetween.

A number of tests and comparative tests were performed to investigate the characteristics and properties of foldable cones having upper end portions secured together at predetermined distances from their bottom edges, and to compare them with foldable cones having side panels secured together only near the upper edge of the side panels. These test results are included below in EXPERIMENT 1. In that regard, EXPERIMENT 1 describes results from a structural integrity test performed on foldable cone samples shown and described with respect to FIGS. 10-16. It will become apparent from the experiment described below that the foldable cone samples having side panels secured together at predetermined distances from their bottom edges (as generally shown by the foldable cone samples S7-S16 in rows 178 and 182 of FIGS. 10-16) have superior structural integrity characteristics when compared to the foldable cone samples having side panels secured together only near the upper edge of the side panels (as generally shown by the foldable cone samples S1-S3 and S4-S6 shown in rows 170 and 174, respectively, of FIGS. 10-16).

Experiment 1

Foldable Cone Structural Integrity

Figure 10:
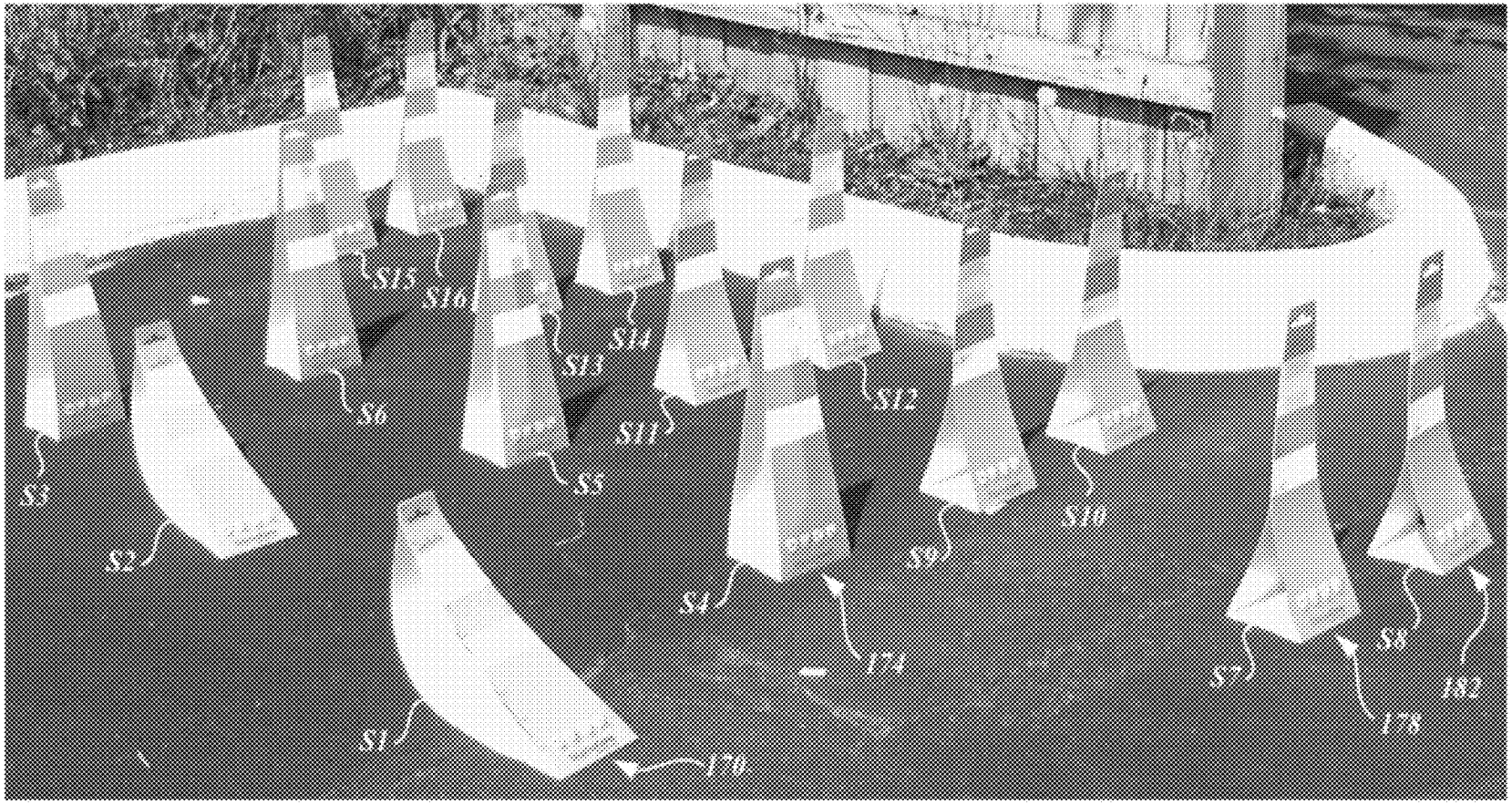
FIG. 10 is a photograph of foldable cone samples formed in accordance with the present disclosure.
Figure 11:
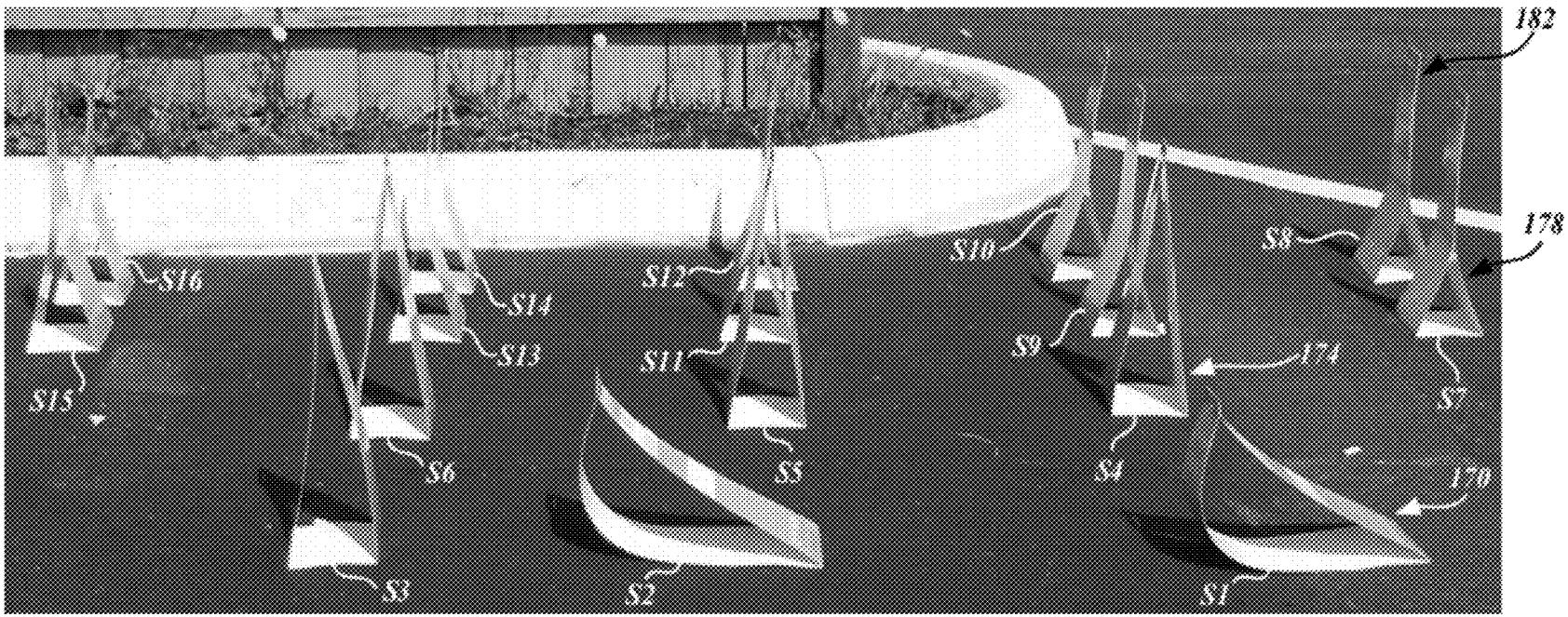
FIG. 11 is a photograph of the foldable cone samples of FIG. 10 taken after a first predetermined amount of time.
Figure 12:
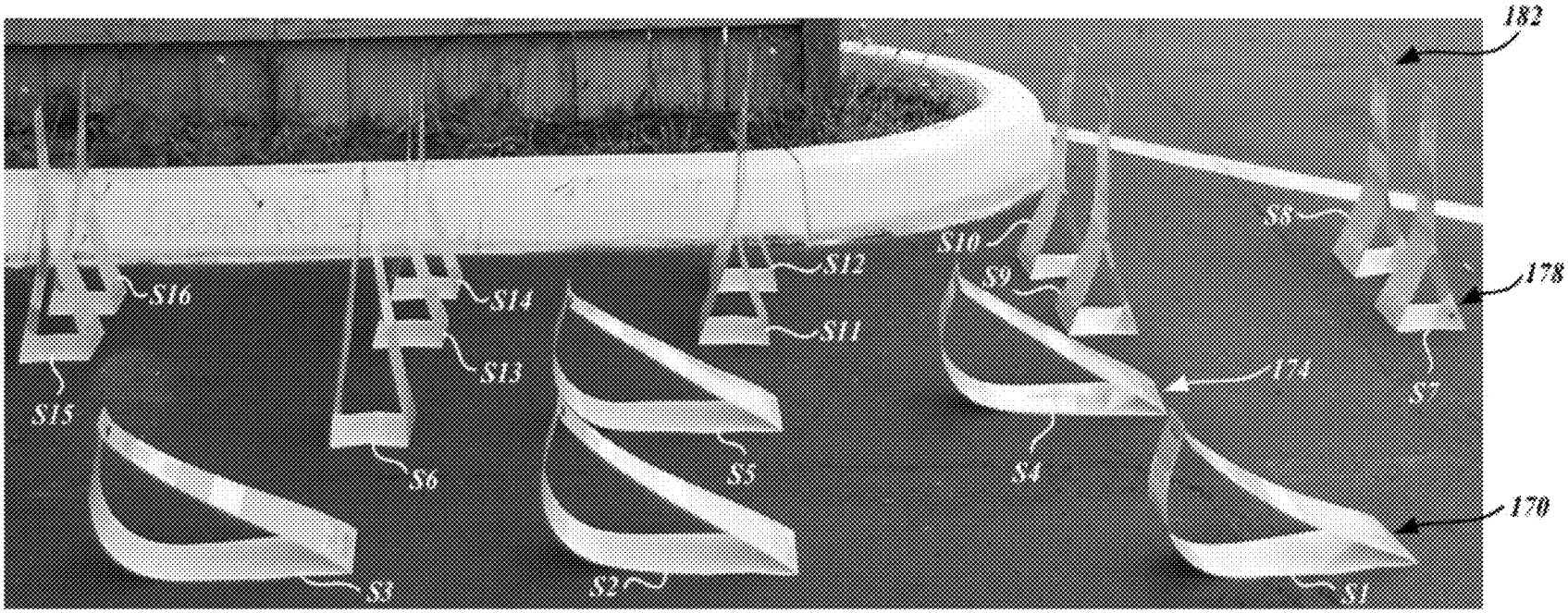
FIG. 12 is a photograph of the foldable cone samples of FIG. 10 taken after a second predetermined amount of time.
Figure 13:
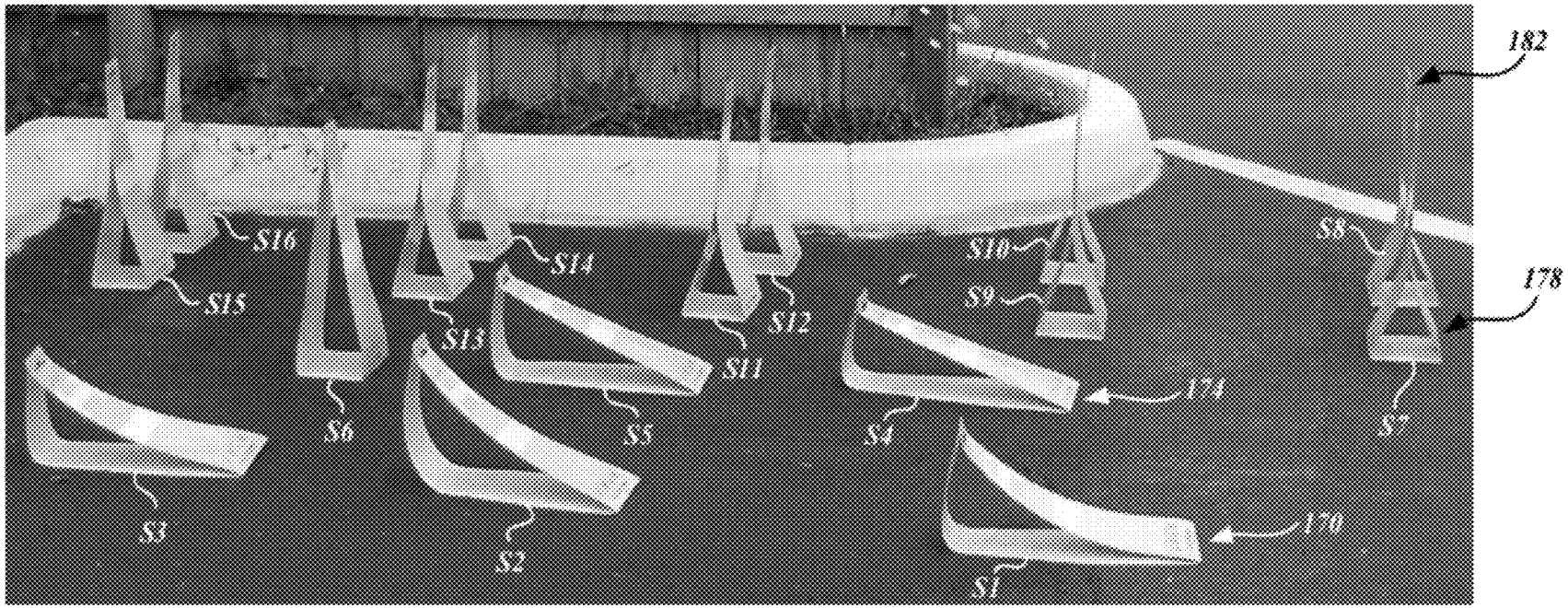
FIG. 13 is a photograph of the foldable cone samples of FIG. 10 taken after a third predetermined amount of time.
Figure 14:
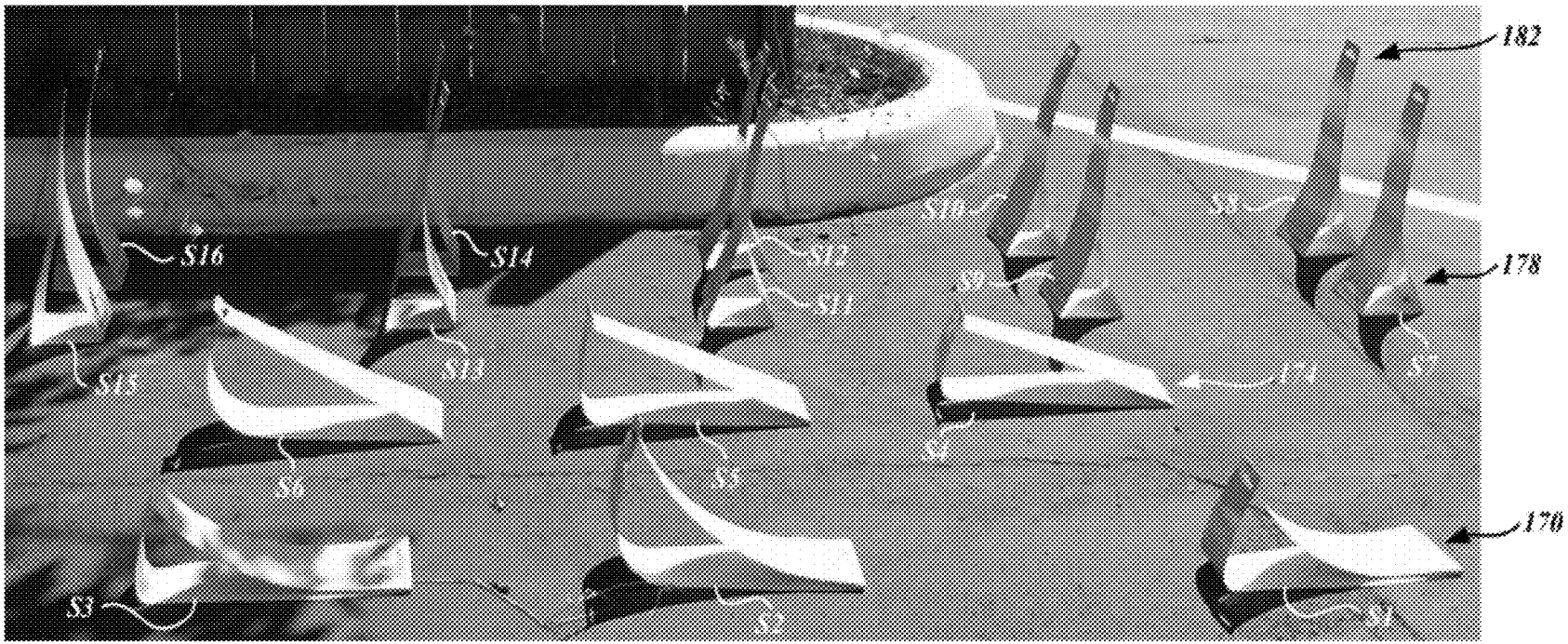
FIG. 14 is a photograph of the foldable cone samples of FIG. 10 taken after a fourth predetermined amount of time.
Figure 15:
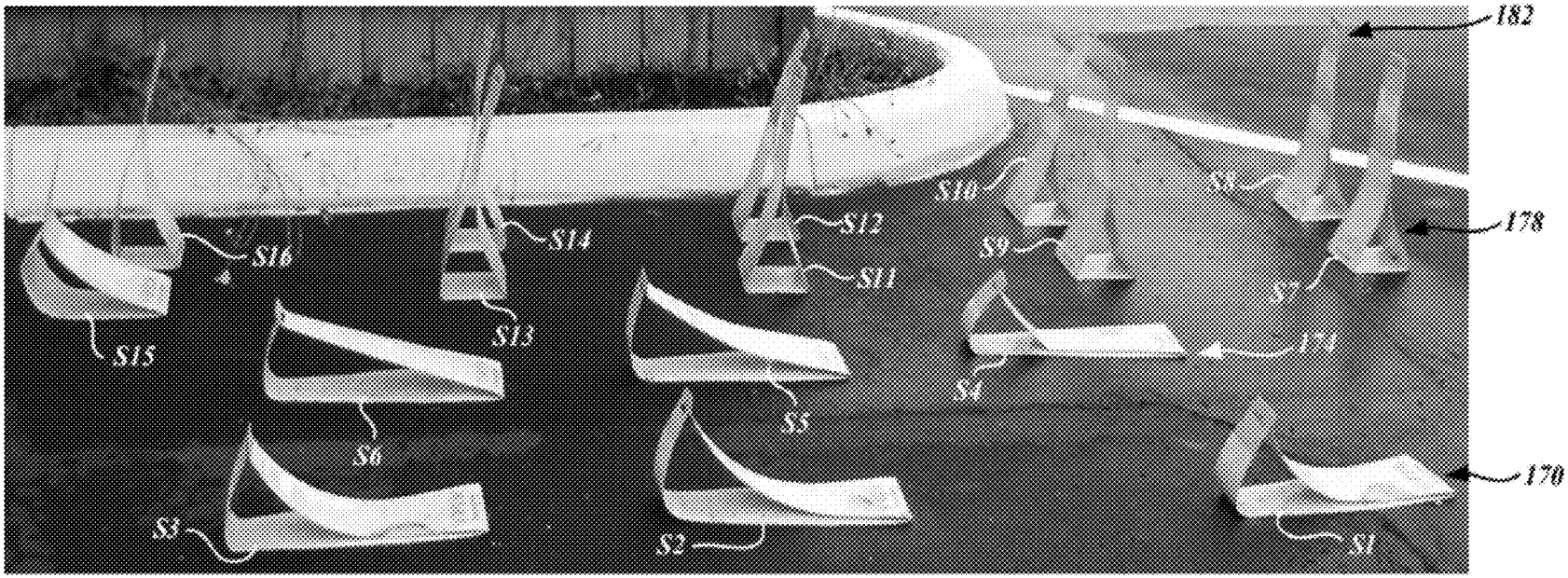
FIG. 15 is a photograph of the foldable cone samples of FIG. 10 taken after a fifth predetermined amount of time.

The purpose of this experiment was to determine the structural integrity of various foldable cone samples S having different structural designs. Referring to FIG. 10, the experiment included three different types of foldable cone samples S arranged into rows. In particular, a first type of sample was arranged into a first row 170 as samples S1-S3. A second type of sample was arranged into a second row 174 as samples S4-S6. A third type of sample was arranged into third and fourth rows 178 and 182 as S7-S16.

The foldable cone samples S1-S3 in row 170 were substantially similar in design to the foldable cone 10 described above with reference to FIGS. 1-5. In particular, the foldable cone samples S1-S3 in row 170 have side panels secured together near the top edge of the side panels. The foldable cone samples S1-S3 in row 170 were assembled into the deployed upright position by unfolding the base panel and adhering the base panel to the ground.

The foldable cone samples S4-S6 in row 174 were also substantially similar in design to the foldable cone 10 described above with reference to FIGS. 1-5. In particular, the foldable cone samples S4-S6 in row 174 have side panels secured together near the top edge of the side panels. The foldable cone samples S4-S6 in row 174 were assembled into the deployed upright position by unfolding the base panel and adhering the base panel to the ground. Each side panel was also folded slightly along its central crimp/indentation when assembling the cone. In particular, the side panel was folded along the central crimp/indentation to bend the center of the side panel outwardly.

The foldable cone samples S7-S16 in rows 178 and 182 were substantially similar in design to the foldable cone 100 described above with reference to FIGS. 6-9. In particular, the foldable cone samples S7-S16 in rows 178 and 182 included side panels secured together at a predetermined distance from the bottom edges of the side panels, wherein the side panels were about eighteen inches (18") in height. A first set of foldable cone samples S7 and S8 in rows 178 and 182 were secured together at eight inches (8") from the bottom edge, a second set of foldable cone samples S9 and S10 in rows 178 and 182 were secured together at nine inches (9") from the bottom edge, a third set of foldable cone samples S11 and S12 in rows 178 and 182 were secured together at ten inches (10") from the bottom edge, a fourth set of foldable cone samples S13 and S14 in rows 178 and 182 were secured together at eleven inches (11") from the bottom edge, and a fifth set of foldable cone samples S15 and S16 in rows 178 and 182 were secured together at twelve inches (12") from the bottom edge. The foldable cone samples S7-S16 in rows 178 and 182 were assembled into the deployed upright position by unfolding the base panel and adhering the base panel to the ground. As can be seen in FIGS. 10-16, the foldable cone samples S7-S16 had side panels that were predisposed into a slightly concave configuration.

To conduct the experiment, the samples S1-S17 were assembled and secured to the ground in rows 170, 174, 178, and 182 on "Day 1" in an outside environment. The structural integrity of the samples S1-S17 was assessed by making periodic observations for changes in the foldable cone sample structural appearance. The output of the experiment was to measure the length of time the foldable cone sample S1-S17 remained in an upright position in which the side panel(s) of the foldable cone sample did not touch the ground surface. Data was gathered for each of the samples S1-S17 and is tabulated in TABLE 1 below.

TABLE 1

| Sample | Day 1 | Day 2 | Day 7 | Day 11 | Day 14 | Day 38 |
|---|---|---|---|---|---|---|
| S1 | N | N | N | N | N | N |
| S2 | N | N | N | N | N | N |
| S3 | Y | N | N | N | N | N |
| S4 | Y | N | N | N | N | N |
| S5 | Y | N | N | N | N | N |
| S6 | Y | Y | Y | N | N | N |
| S7 | Y | Y | Y | Y | Y | Y |
| S8 | Y | Y | Y | Y | Y | Y |
| S9 | Y | Y | Y | Y | Y | Y |
| S10 | Y | Y | Y | Y | Y | Y |
| S11 | Y | Y | Y | Y | Y | Y |
| S12 | Y | Y | Y | Y | Y | Y |
| S13 | Y | Y | Y | Y | Y | Y |
| S14 | Y | Y | Y | Y | Y | Y |
| S15 | Y | Y | Y | Y | N | N |
| S16 | Y | Y | Y | Y | Y | N |

Legend:
Y = sample is upright (no side panel in contact with ground surface)
N = sample is not upright (side panel in contact with ground surface)

As can be understood by referring to the results shown in TABLE 1 above, the foldable cone samples S7-S16 maintained an upright position at least ten days longer than samples S1-S5. Thus, it can be appreciated that the foldable cone samples S7-S16, which included side panels secured together at a predetermined distance from the bottom edges of the side panels (from eight inches (8") to twelve inches (12")) to define side panels having a slightly concave configuration, had considerably higher structural integrity than samples S1-S3 (which were secured together near the top edge of the side panels) and samples S4-S6 (which were secured together near the top edge of the side panels and which were also folded outwardly slightly along the center longitudinal crimp/indentation).

Moreover, samples S7-S14 maintained the upright position for the entire thirty-eight days of the experiment. As set forth above, samples S7 and S8 were secured together at 8" from the bottom edge, samples S9 and S10 were secured together at 9" from the bottom edge, samples S11 and S12 were secured together at 10" from the bottom edge, and samples S13 and S14 were secured together at 11" from the bottom edge.

Although samples S7-S14 all remained in the upright configuration for the duration of the experiment, the inventor has found that samples S13 and S14 (secured together at 11" from the bottom edge) have the most beneficial structural characteristics. As discussed above in describing the foldable cones 10 and 100, to erect the cone and secure the cone to a surface, the adhesive on the bottom of the base panel may be set relative to the floor, road surface, or other surface on which the cone is placed by simply using one's foot to press down on the upper surface of the base panel, which is easily accomplished since the cone is hollow. Moreover, when erected, side winds will simply flow through the hollow interior of the cone. The inventor has found that a foldable cone having the side panels secured together at about 11" from the bottom edge (wherein the cone is 18" in height), or at about 60% of the height of the foldable cone, provides the structural integrity for maintaining the foldable cone in an upright position while providing a sufficient opening for using one's foot to secure the base panel of the cone to a surface and while allowing sufficient air to flow through the hollow opening of the cone.

While preferred embodiments of the invention have been illustrated and described, it will be appreciated that various changes can be made therein without departing from the spirit and scope of the invention.

The embodiments of the invention in which an exclusive property or privilege is claimed are defined as follows:

1. A foldable cone, comprising:

(a) first and second side panels that are tapered in the upward direction, each side panel having an outer surface and an inner surface, a lower edge, an upper edge, and opposing side edges;

(b) a base panel having a folding seam extending along the central portion thereof in a direction generally parallel to the lower edges of the side panels, wherein the base panel folds along the folding seam;

wherein the first and second side panels are secured together at a predetermined location to define concave first and second side panels when the base panel is unfolded; and (c) one or more crimp lines extending longitudinally along each of the first and second side panels.

2. The foldable cone of claim 1, wherein the first and second side panels are secured together at a distance that is in between 50-70% of the height of the first and second side panels.

3. The foldable cone of claim 1, wherein the first and second side panels are secured together at a distance substantially equal to 60% of the height of the first and second side panels.

4. The foldable cone of claim 1, wherein the first and second side panels are unattached at their upper ends to define a slot between the first and second side panels.

5. The foldable cone of claim 1, further comprising a first lateral crimp line formed near a first edge of the first and second side panels and a second lateral crimp line formed near a second edge of the first and second side panels.

6. The foldable cone of claim 1, wherein the base panel may be folded along the foldable seam in an upwards direction, and wherein when the base panel is folded, the foldable cone is substantially flattened into a planar configuration.

7. The foldable cone of claim 1, wherein the two tapered side panels have upper end portions, and wherein substantially aligned openings are formed in the upper end portions.

8. The foldable cone of claim 1, wherein the tapered side panels are tapered such that the width of the side panel upper edges is from ¼ to ½ the width of the side panel lower edges.

9. The foldable cone of claim 1, wherein the foldable cone is composed of a material selected from one or more of paper, plastic and fabric.

10. The foldable cone of claim 1, wherein the base panel has an underside; and wherein an adhesive material is placed on the underside of the base panel to retain the cone from moving once placed in a desired location.

11. The foldable cone of claim 1, wherein the exterior surfaces of the side panels are light reflective.

12. The foldable cone of claim 1, wherein the exterior surfaces of the side panels are printed with warning indicia.

13. The foldable cone of claim 1, wherein indicia are provided along the length of the side panels to indicate the length of the side panels.

14. A foldable cone, comprising:

(a) first and second side panels that are tapered in the upward direction, each side panel having an outer surface and an inner surface, a lower edge, an upper edge, and opposing side edges, wherein the first and second side panels are secured together at a distance that is in between 50-70% of the height of the side panel;

(b) a base panel having a folding seam extending along the central portion thereof in a direction generally parallel to the lower edges of the side panels, wherein the base panel folds along the folding seam; and (c) one or more crimp lines extending longitudinally along each of the first and second side panels.

15. The foldable cone of claim 14, wherein the first and second side panels are secured together at a distance substantially equal to 60% of the height of the first and second side panels.

16. The foldable cone of claim 14, wherein the first and second side panels are unattached at their upper ends to define a slot between the first and second side panels.

17. The foldable cone of claim 14, wherein the one or more crimp lines comprises a first lateral crimp line formed near a first edge of the first and second side panels and a second lateral crimp line formed near a second edge of the first and second side panels.

18. A foldable cone, comprising:

(a) first and second side panels that are tapered in the upward direction, each side panel having an outer surface and an inner surface, a lower edge, an upper edge, and opposing side edges;

(b) a base panel having a folding seam extending along the central portion thereof in a direction generally parallel to the lower edges of the side panels, wherein the base panel folds along the folding seam;

wherein the first and second side panels are secured together at a predetermined location to define concave first and second side panels when the base panel is unfolded; and wherein the first and second side panels are secured together at a distance that is in between 50-70% of the height of the first and second side panels.

* * * * *